US006746095B2

(12) United States Patent
Kobayashi et al.

(10) Patent No.: US 6,746,095 B2
(45) Date of Patent: Jun. 8, 2004

(54) MULTINOZZLE INK JET RECORDING DEVICE CAPABLE OF IDENTIFYING DEFECTIVE NOZZLE

(75) Inventors: Shinya Kobayashi, Hitachinaka (JP); Takahiro Yamada, Hitachinaka (JP); Hitoshi Kida, Hitachinaka (JP); Kunio Satou, Hitachinaka (JP); Katsunori Kawasumi, Hitachinaka (JP); Kazuo Shimizu, Hitachinaka (JP)

(73) Assignee: Hitachi Printing Solutions, Ltd., Kanagawa-Ken (JP)

( * ) Notice: Subject to any disclaimer, the term of this patent is extended or adjusted under 35 U.S.C. 154(b) by 0 days.

(21) Appl. No.: 09/956,861

(22) Filed: Sep. 21, 2001

(65) Prior Publication Data

US 2002/0041304 A1 Apr. 11, 2002

(30) Foreign Application Priority Data

Sep. 29, 2000 (JP) ..... P2000-297949

(51) Int. Cl.[7] ..... B41J 2/165
(52) U.S. Cl. ..... 347/23; 347/19
(58) Field of Search ..... 347/23, 19, 37, 347/40, 43, 76, 77, 44

(56) References Cited

U.S. PATENT DOCUMENTS 3,981,019 A * 9/1976 Fujimoto et al. ..... 347/80
4,907,013 A * 3/1990 Hubbard et al. ..... 347/19
5,117,244 A * 5/1992 Yu ..... 347/29
5,560,543 A * 10/1996 Smith et al. ..... 239/102.2
5,646,654 A * 7/1997 Widder ..... 347/14
6,293,645 B1 * 9/2001 Kim ..... 347/23
6,332,662 B1 * 12/2001 Choi ..... 347/19
6,460,963 B1 * 10/2002 Endo ..... 347/19
6,604,807 B1 * 8/2003 Murcia et al. ..... 347/19

FOREIGN PATENT DOCUMENTS

JP 47-7847 3/1972
JP 361035959 A * 2/1986

* cited by examiner

*Primary Examiner*—Shih-wen Hsieh
(74) *Attorney, Agent, or Firm*—Whitham, Curtis & Christofferson, P.C.

(57) ABSTRACT

When ink droplets are ejected, angled or splashed where a plurality of minute ink droplets are generated, angled or splashed ink clings on an electrode 401, 402 and increases the amount of electric current conducted therethrough. Hence, the defectiveness of ink ejection can be detected by monitoring the amount of the electric current. When the defectiveness of ink ejection is detected, ejection data D is retrieved and updates the ejection data D based on a condition register S, and set to a defect register E. When the defect register E has only one element that takes a condition value of 1 indicating defectiveness, the corresponding nozzle is identified as defective. The restoring means reallocates dots, which have been originally allocated to the defective nozzle, to neighboring nozzle.

20 Claims, 11 Drawing Sheets

| ELECTRIC VOLTAGE Vchg (V) | DEFLECTION AMOUNT c (μm) | AVERAGE SPEED Vav (m/sec) |
|---|---|---|
| 200 | 187 | 2.45 |
| 100 | 94 | 2.49 |
| 0 | 0 | 2.46 |
| -100 | -94 | 2.38 |
| -200 | -187 | 2.42 |

FIG.8(a)
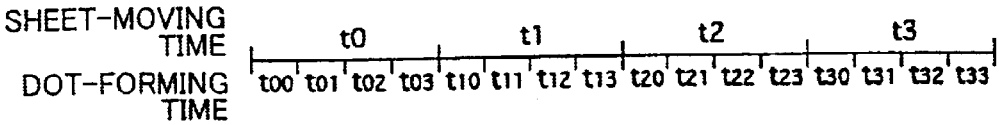
FIG.8(b)
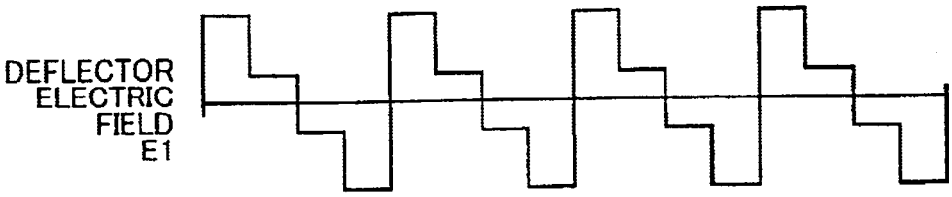
FIG.8(c)
EJECTION DATA 112
| | | | | | | | | | | | | | | | | |
|---|---|---|---|---|---|---|---|---|---|---|---|---|---|---|---|---|
| x | 3 | 2 | 1 | 0 | 3 | 2 | 1 | 0 | 3 | 2 | 1 | 0 | 3 | 2 | 1 | 0 |
| y | 0 | 0 | 0 | 0 | 1 | 1 | 1 | 1 | 2 | 2 | 2 | 2 | 3 | 3 | 3 | 3 |
FIG.8(d)
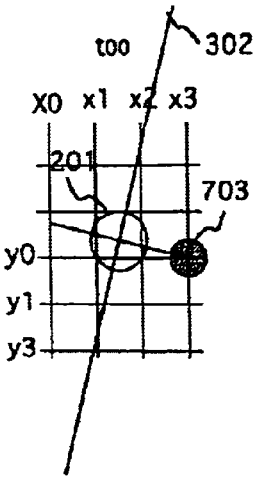
FIG.8(e)
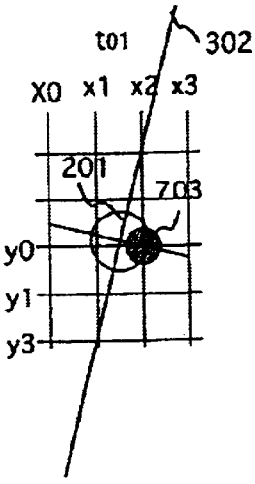
FIG.8(f)
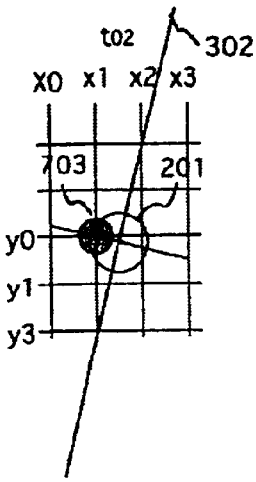
FIG.8(g)
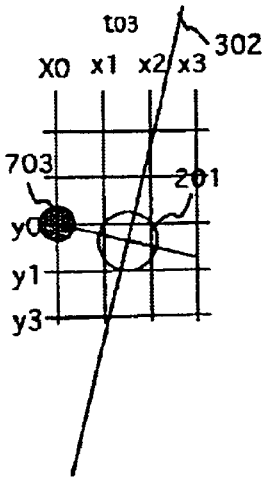

MULTINOZZLE INK JET RECORDING DEVICE CAPABLE OF IDENTIFYING DEFECTIVE NOZZLE

BACKGROUND OF THE INVENTION

1. Field of the Invention

The present invention relates to a multi-nozzle ink jet recording device, and more specifically to a highly reliable multi-nozzle ink jet recording device capable of automatically detecting defective nozzles and restoring normal printing without performing a test-pattern printing.

2. Related Art

Japanese Patent Publication No. SHO-47-7847 discloses a conventional ink jet recording device formed with a plurality of nozzles aligned in a line in a widthwise direction of a recording sheet. Ink droplets ejected from the nozzles impact and form dots on the recording sheet while the recording sheet is moved in a sheet feed direction perpendicular to the widthwise direction, thereby forming dot images on the recording sheet. The ejected ink droplets are uniform in their size and separated one from the other.

The recording device also includes electrodes that generate a charging electric field and a deflector electric field for respective nozzles. The charging electric field charges the ejected ink droplets based on a recording signal, and the deflector electric field having a uniform magnitude changes a flying direction of the charged ink droplets as needed, thereby controlling the impact positions of the ink droplets with respect to the widthwise directions so as to form the dots on exact target positions.

There has been also proposed a nozzle array where a plurality of nozzles are formed in an arrayed manner, which improves recording speed. However, increase in the number of nozzles sacrifices the reliability of the device.

Air bubbles and any foreign substances existing within a nozzle will result in ink droplets ejected at an angle and also in a splash where unintended minute ink droplets are generated. In worse case, no ejection is performed.

Moreover, when the ejection direction is angled or when the splash is caused in this manner, ink droplets may impact and cling on the electrodes. Especially, the splashed minute ink droplets have a low flying speed and a greater deflection amount because of their small diameter, so a large number of minute ink droplets cling on the electrodes. Because the ink has been charged by the charging electric field, the ink clinging on the electrodes increases an electric current conducting through the electrodes. Therefore, a nozzle corresponding to the electrodes with increased electric current can be easily detected defective.

However, the above method for detecting defective nozzles is not useful in a recording device including common electrodes used common to a plurality of nozzles. Specifically, when there is any change in electric current, it can be known that there is a defective nozzle(s). However, because the amount of change in the electric current due to a single defective nozzle is unknown and fluctuates, it is impossible to detect the number of defective nozzle(s) or to identify the defective nozzle(s). For example, even if defective ejection is detected when droplets are ejected from two nozzles at one time, it cannot detect which one of the two nozzles is defective or whether both of the two nozzles are defective.

It is conceivable to perform a test-pattern printing where an ink droplet is ejected from each one of the nozzles one at a time. Then, it is determined whether or not each nozzle is defective or normal by using a laser beam or a CCD sensor. However, this method is time consuming and wastes ink, and it is impossible to perform such a time-consuming test-pattern printing during actual image forming operations. Moreover, there is hardly a case when an ink droplet is ejected from only a single nozzle during the actual printing, not the test-pattern printing, so it is unrealistic to wait such a single-nozzle printing during the actual printing to detect defectiveness of each nozzle. That is, even when a nozzle becomes defective during printing, there has been no conventional means for restoring the normal printing during the printing, so that there has been no choice but to continue the defective printing with the defective nozzle.

There is a choice to temporarily stop the printing to detect a defective nozzle. However, this method wastes time required for the detection, wastes ink contributed for the detection, and requires disposing the ink contributed for the detection. Accordingly, it is preferable to avoid such an operation as much as possible.

SUMMARY OF THE INVENTION

It is therefore an objective of the present invention to overcome the above problems, and also to provide a highly reliable multi-nozzle ink jet recording device capable of automatically detecting defective nozzles and restoring normal printing without performing a test-pattern printing.

In order to overcome the above and other objectives, there is provided an ink jet recording device including a head, electrodes, first detecting means, and identifying means. The head is formed with a plurality of nozzles through which ink droplets are selectively ejected based on ejection data during printing. The electrodes are provided common to the plurality of nozzles. The first detecting means detects whether all of selected nozzles through which ink droplets are ejected are normal or at least one of the selected nozzles is defective. The identifying means automatically identifies a defective nozzle while the head is continuously performing the printing when the first detecting means detects that the ejection is performed defective.

There is also provided a detecting method of detecting a defective nozzle among a plurality of nozzles formed to a head of an ink jet recording device that includes the head and electrodes for generating a deflection electric field common to the plurality of nozzles. The detecting method includes the steps of a) detecting whether all of selected nozzle through which ink droplets are ejected are normal or at least one of the selected nozzles is defective, and b) identifying a defective nozzle among the plurality of nozzles while the head continuously performing the printing when the ejection is detected defective in step a).

BRIEF DESCRIPTION OF THE DRAWINGS

In the drawings:

FIG. 3(*b*) is a plan view showing the ejection surface of the recording head;

FIG. 8(*a*) is an explanatory view showing a dot frequency and a deflected-dot frequency;

FIG. 8(*b*) is an explanatory view showing change in magnitude of a deflector electric field;

FIG. 8(*c*) is an explanatory view showing ejection data;

FIG. 8(*d*) is an explanatory view showing a positional relationship between an orifice and an impact position of a deflected ink droplet;

FIG. 8(*e*) is an explanatory view showing a positional relationship between an orifice and an impact position of a deflected ink droplet;

FIG. 8(*f*) is an explanatory view showing a positional relationship between an orifice and an impact position of a deflected ink droplet;

FIG. 8(*g*) is an explanatory view showing a positional relationship between an orifice and an impact position of a deflected ink droplet;

PREFERRED EMBODIMENTS OF THE PRESENT INVENTION

Next, a line-scanning-type multi-nozzle ink jet recording device and a recording method according to an embodiment of the present invention will be described while referring to the accompanying drawings.

First, overall configuration of the line-scanning-type multi-nozzle ink jet recording device 1 will be described while referring to FIGS. 1 to 8.

Figure 1:
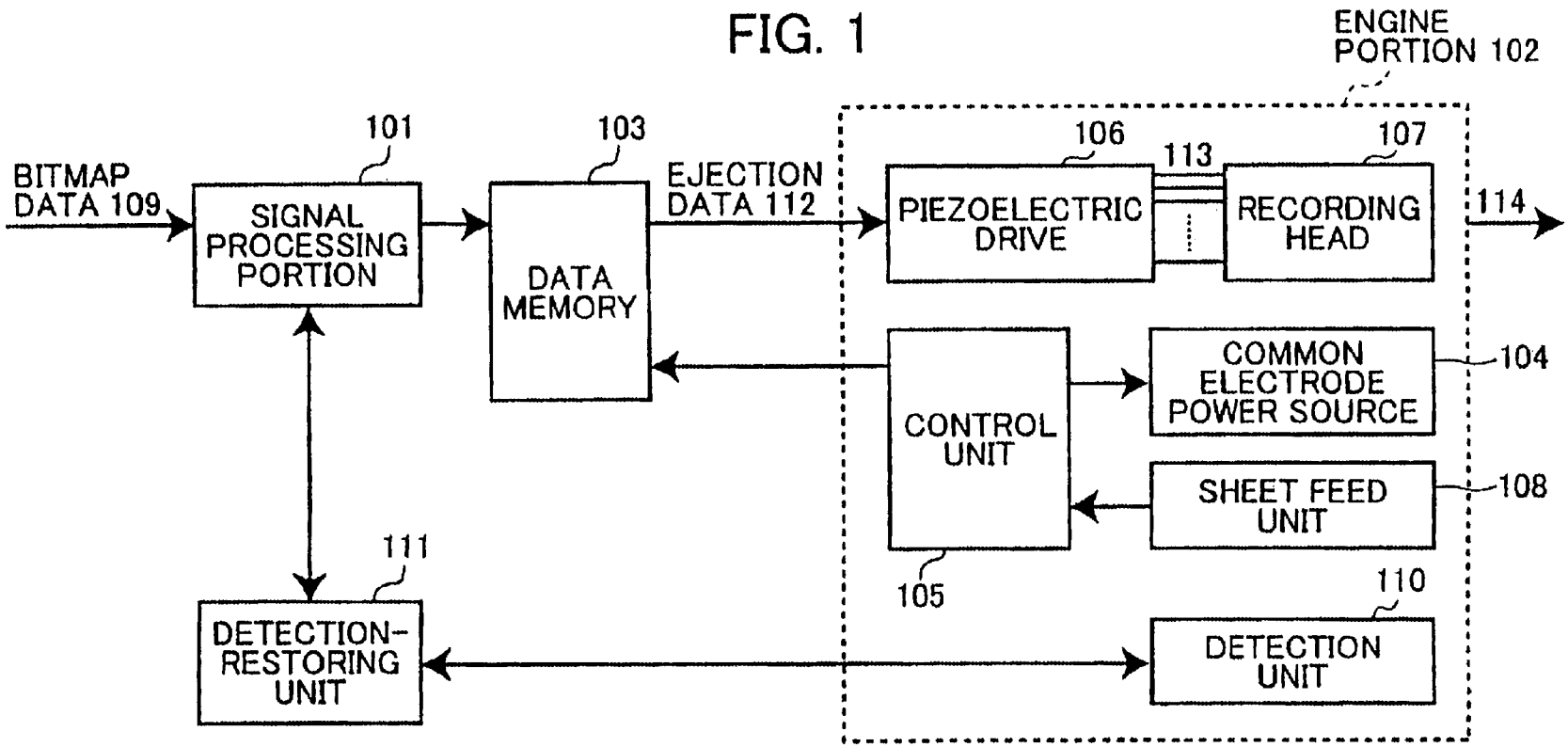
FIG. 1 is a block diagram of components of an ink jet recording device according to an embodiment of the present invention.
Figure 2:
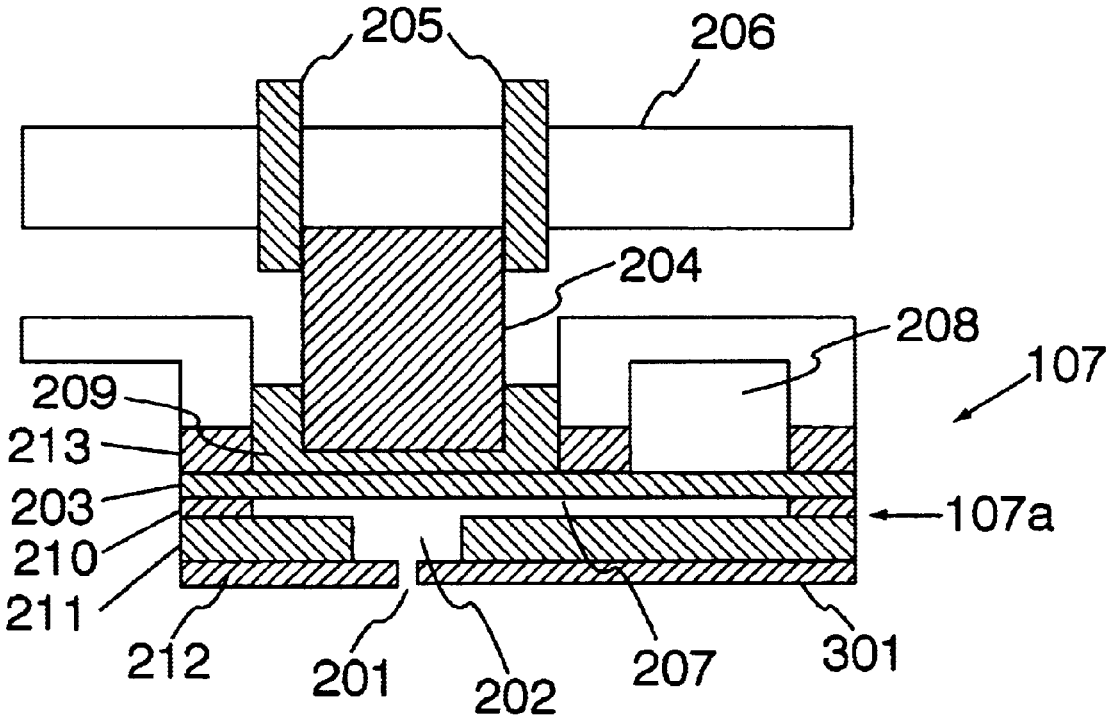
FIG. 2 is a cross-sectional view of a nozzle formed to a recording head of the ink jet recording device.

As shown in FIG. 1, the ink jet recording device 1 includes a signal processing portion 101, a data memory 103, an engine portion 102, and a detection-restoring unit 111. The engine portion 102 includes a control unit 105, a piezoelectric driver 106, a recording head 107, a common electrode power source 104, a sheet feed unit 108, and a detection unit 110. The recording head 107 is formed with a plurality of nozzles 107*a* (FIG. 2). Because the piezoelectric driver 106 has a well-known configuration, detailed description thereof will be omitted.

When the ink jet recording device 1 is a full-color recording device, a plurality of recording heads 107 are provided for a plurality of different colored ink. However, in the present embodiment, it is assumed that the ink jet recording device 1 is a monochromatic recording device, and that only one recording head 107 is provided.

The signal processing portion 101 is a well-known microcomputer, and receives a bitmap data 109, which is binary data, from an external computer and the like (not shown). When the ink jet recording device 1 is the full-color recording device, a plurality of sets of the bitmap data 109 are usually provided for the recording heads 107.

Upon receipt of the bitmap data 109, the signal processing portion 101 generates ejection data 112 for each of the nozzles 107*a* of the recording head 107 based on the bitmap data 109 and a prestored program. The ejection data 112 is arranged, based on position information of each nozzle 107*a* and deflection information of ink droplets, in an order in which ink droplets are ejected. The signal processing portion 101 temporarily stores one-scanning-worth or one-page-worth of the ejection data 112 into the data memory 103.

The control unit 105 of the engine portion 102 controls the sheet feed unit 108 and the common electrode power source 104. When printing is started, the sheet feed unit 108 starts feeding a recording sheet. At the same time, the common electrode power source 104 applies an electric voltage to common electrodes 401, 402 (FIGS. 4 and 5) to be described later, thereby generating a charging electric field and a deflector electric field. When a recording position of the recording sheet reaches the recording head 107, the control unit 105 outputs a request command to the data memory 103, the request command requesting the signal data memory 103 to output the ejection data 112. The ejection data 112 is input to the piezoelectric driver 106, and the piezoelectric driver 106 outputs a print signal 113 to each nozzle 107*a* of the recording head 107. As a result, an image 114 is formed on the recording sheet.

In the ink jet recording device 1 of the present embodiment, printing is performed by the recording head 107 that is held still while the recording sheet is transported.

As shown in FIG. 2, each nozzle 107*a* of the recording head 107 includes a diaphragm 203, a piezoelectric element 204, a signal input terminal 205, a piezoelectric element supporting substrate 206, a restrictor plate 210, a pressure-chamber plate 211, an orifice plate 212, and a supporting plate 213. The diaphragm 203 and the piezoelectric element 204 are attached to each other by a resilient member 209, such as a silicon adhesive. The restrictor plate 210 defines a restrictor 207. The pressure-chamber plate 211 and the orifice plate 212 define a pressure chamber 202 and an orifice 201, respectively. The orifice plate 212 has an ejection surface 301. A common ink supply path 208 is formed above the pressure chamber 202 and is fluidly connected to the pressure chamber 202 via the restrictor 207. Ink flows from above to below through the common ink supply channel 208, the restrictor 207, the pressure chamber 202, and the orifice 201. The restrictor 207 regulates an ink amount supplied into the pressure chamber 202. The supporting plate 213 supports the diaphragm 203. The piezoelectric element 204 deforms when a voltage is applied to the signal input terminal 205, and maintains its initial shape when no voltage is applied.

The diaphragm 203, the restrictor plate 210, the pressure-chamber plate 211, and the supporting plate 213 are formed from stainless steel, for example. The orifice plate 212 is formed from nickel material. The piezoelectric element supporting substrate 206 is formed from an insulating material, such as ceramics and polyimide.

The print signal 113 output from the piezoelectric driver 106 is input to the signal input terminal 205. In accordance with the print signal 113, uniform ink droplets separated from each other are ejected, ideally outwardly with respect to a normal line of the orifice plate 212, from the orifice 201.

Figure 3A:
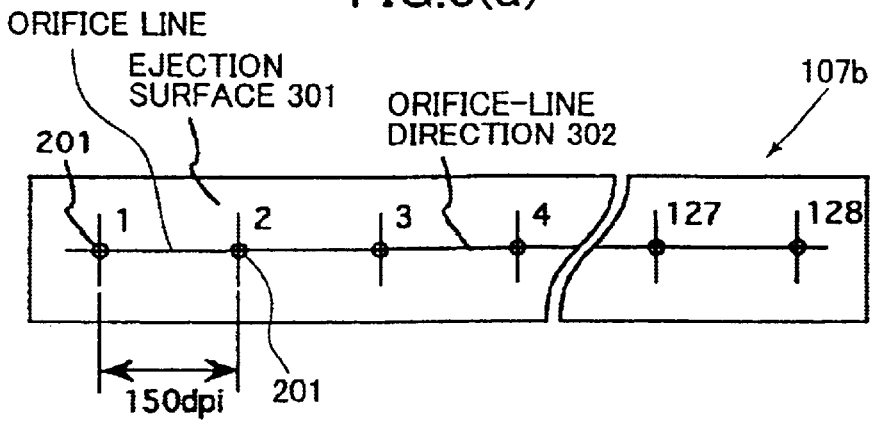
FIG. 3(*a*) is a plan view partially showing an ejection surface of the recording head.
Figure 3B:
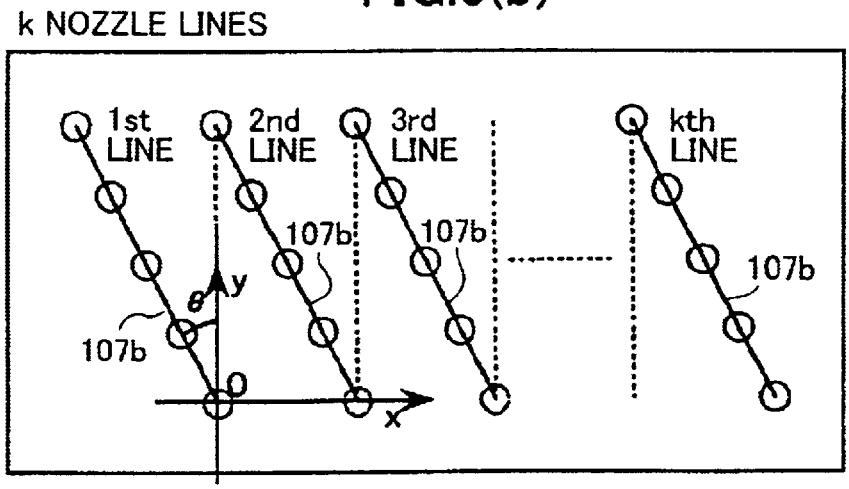

As shown in FIG. 3(*b*), a plurality of orifice lines 107*b* are formed to the recording head 107. Details will be described below.

As shown in FIG. 3(*b*), the ejection surface 301 is formed with a plurality of the orifice lines 107*b* arranged side by side in an x direction and each extending in an orifice-line direction 302, which is inclined by θ with respect to a y direction perpendicular to the x direction. As shown in FIG. 3(*a*), each orifice line 107*b* includes 128 orifices 201 arranged at a pitch of 75 orifices/inch in the orifice-line direction 302. Although not indicated in the drawings, adjacent orifice lines 107*b* usually overlap each other in the x direction by several-dot-worth amount.

In actual assembly, a plurality of head portions of FIG. 3(*a*) are assembled into the single head 107 of FIG. 3(*b*). The above arrangement prevents unevenness in color density of recorded image, which appears in a black or white band, due to erroneous attachment of the head portions and uneven nozzle characteristics, and also enables assembly of the recording head 107 elongated in the x direction.

Figure 4:
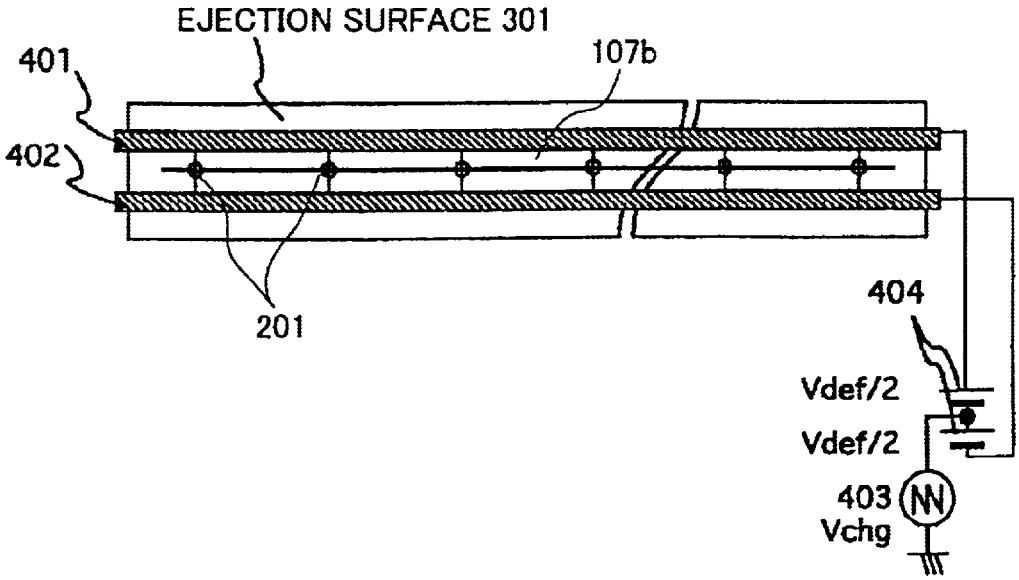
FIG. 4 is an explanatory plan view showing the ejection surface and common electrodes.
Figures 5, 6:
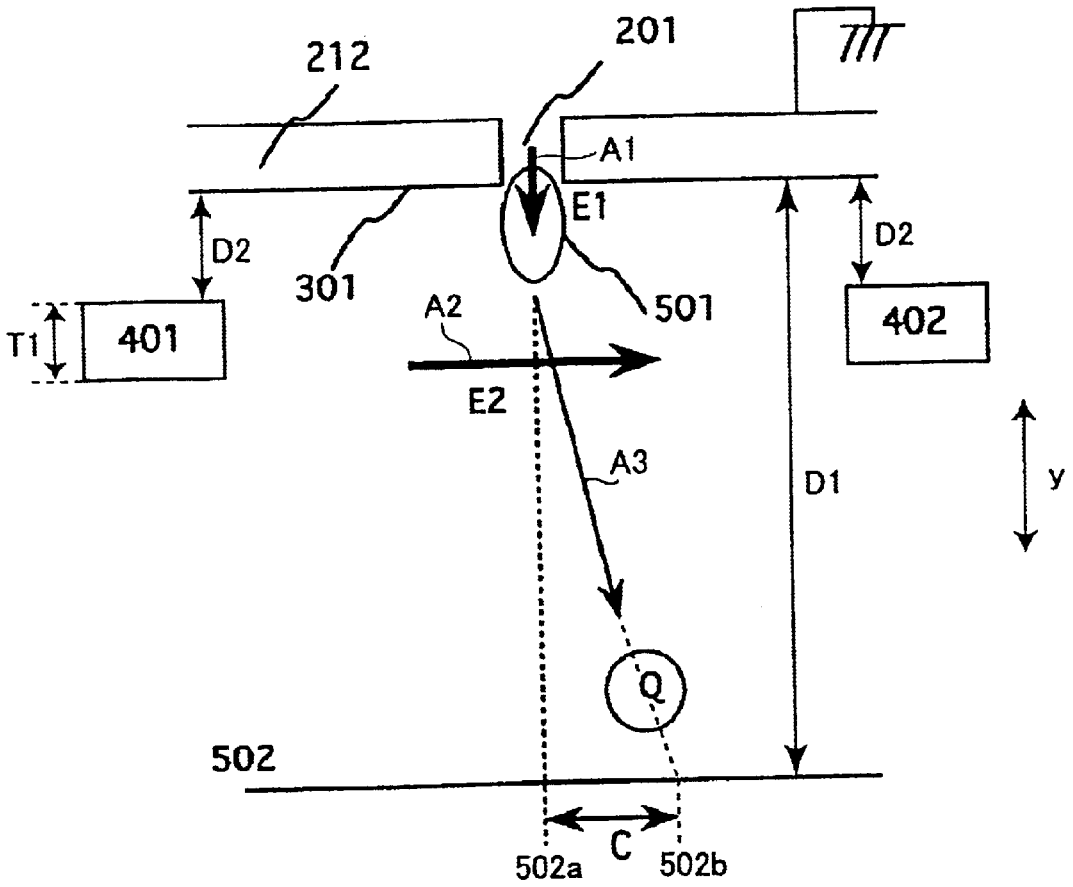
FIG. 5 is an explanatory cross-sectional view showing ink droplet deflection.
FIG. 6 is a table indicating deflection results.

As shown in FIGS. 4 and 5, the common electrodes 401, 402 are provided for each orifice line 107*b*, at positions between the ejection surface 301 and a recording sheet 502. The common electrodes 401, 402 extend parallel to and sandwich the corresponding orifice line 107*b* in a plan view. In the present embodiment, a distance D1 from the orifice plate 212 to the recording sheet 502 is 1.6 mm. A distance D2 from the orifice plate 212 to the common electrode 401 (402) is 0.3 mm. Each common electrode 401, 402 has a thickness T1 of 0.3 mm in the y direction. The common electrodes 401 and 402 are separated from each other by a distance of 1 mm.

As shown in FIG. 4 there are provided an alternate current (AC) power source 403 and a pair of direct current (DC) power sources 404. The AC power source 403 outputs an electric voltage Vchg. As will be described later, the value of the electric voltage Vchg is changed among several different values in a predetermined frequency. Each of the DC power sources 404 outputs an electric voltage Vdef/2. With this configuration, an electric voltage of Vchg+VdefY/2 and Vchg−Vdef/2 are applied to the common electrodes 401 and 402, respectively. The orifice plate 212 having the ejection surface 301 is connected to the ground.

As shown in FIG. 5, the common electrodes 401, 402 and the orifice plate 212 together generate a charging electric field E1 in a region near the orifice 201. Because the orifice plate 212 is conductive and connected to the ground, the direction of the charging electric field E1 is parallel to the normal line of the orifice plate 212 as indicated by an arrow A1. The common electrodes 401 and 402 also generate a deflector electric field E2 having a direction from the common electrode 401 to the common electrode 402 as indicated by an arrow A2. That is, the deflector electric field E2 has the direction A2 perpendicular to the orifice-line direction 302. The magnitude of the deflector electric field E2 is in proportion to the electric voltage Vdef. The electric voltage Vdef is maintained at 400V in this embodiment.

Because the orifice 201 is separated from both the electrodes 401 and 402 by the same distance, the electric voltage applied to an ink droplet 501, which is about to be ejected, is in proportion to the electric voltage Vchg. Accordingly, at the time of ejection from the orifice 201, the ink droplet 501 is charged with a voltage of Q which has a magnitude in proportion to the electric voltage Vchg and a polarity opposite to the electric voltage Vchg. In this way, the electric field E1 charges the ink droplet 501.

After ejection, the flying speed of the ink droplet 501 is accelerated by the charging electric field E1. When the ink droplet 501 reaches between the common electrodes 401 and 402, the deflector electric field E2 deflects the ink droplet 501 toward the direction A2 of the electric field E2 and changes its flying direction to a direction indicated by an arrow A3. Then, the ink droplet 501 impacts on the recording sheet 502 at a position 502*b* shifted in the direction A2 by a distance C from an original position 502*a* where the ink droplet 501 would have impacted if not deflected at all. The distance C between the actual impact position 502*b* and the original position 502*a* is referred to as deflection amount C hereinafter.

FIG. 6 shows a table indicating the relationships among the deflection amounts C (μm) and average flying speeds Vav (m/sec) obtained when the AC voltage Vchg are 200V, 100V, 0V, −100V, and −200V. The average flying speed Vav indicates an average flying speed of the ink droplet 501 from when the ink droplet 501 is ejected from the orifice 201 until impacts on the recording sheet 502.

It should be noted that a flying time T from when the ink droplet 501 is ejected until when the ink droplet impacts on the recording sheet 502 is ignored in the explanation. This is because fluctuation in the deflection amount C within values that the deflection amount C takes during actual printing hardly varies the flying time T. A possible explanation for this is that when the deflection amount C is relatively large, a flying distance of the ink droplet 501 increases. However, in this case, the charging amount Q also increases, and this in turn increases acceleration rate cased caused by the charging electric field E1 and the deflecting electric field E2, thereby increasing the average speed Vav of the ink droplet 501. Accordingly, the flying time T stays unchanged regardless of the deflection amount C.

Figure 7:
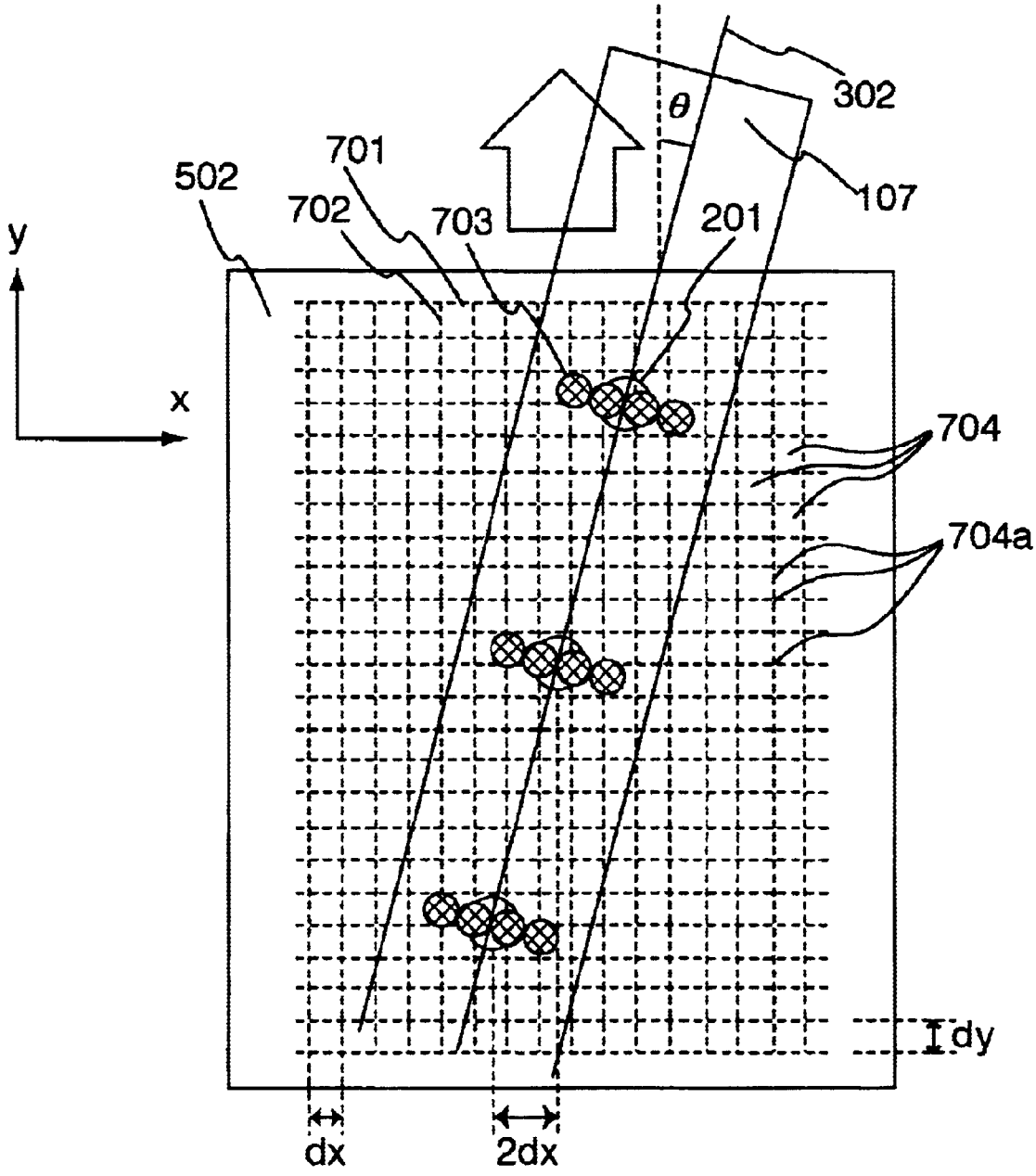
FIG. 7 is an explanatory view showing a partial configuration of engine portion including the recording head 107.

Next, an x-y coordinate system used in this embodiment will be described while referring to FIG. 7. The x-y coordinate system is defined on the recording sheet 502, and includes a plurality of x-scanning lines 701 and a plurality of y-scanning lines 702. The x-scanning lines 701 extend in the x direction and align at a uniform interval of dy in the y direction, which is referred to as "resolution interval dy". On the other hand, the y-scanning lines 702 extend in the y direction and align at a uniform interval of dx in the x direction, which is referred to as "resolution interval dx". These x-scanning lines 701 and y-scanning 702 lines intersect one another and define a plurality of grids 704 having grid corners 704*a*. The ink droplets 501 are controlled to impact on one of grid corners 704*a*, which is defined by a coordinate value (dx, dy). It should be noted that in the present embodiment, the recording sheet 502 is moved in the y direction during printing.

In the present embodiment, the recording head 107 is positioned above the recording sheet 502 while its ejection surface 301 faces and extends parallel to the recording sheet 502. The distance between the recording sheet 502 and the ejection surface 301 is between 1 mm and 2 mm.

Next, a specific example of the present embodiment will be described while referring to FIG. 7. In this example, tan θ is set to ¼. Also, the charging electric field E1 takes four different magnitudes, i.e., a deflection number n is 4, so an ink droplet 501 ejected from a single orifice 201 is deflected by one of four deflection amounts C, and impacts on one of four impact positions 703. Because it is desirable to decrease the deflection amount C, the four impact positions 703 are symmetrically arranged to the left and right sides of the orifice 201.

Also, in the present example, two adjacent orifices 201 are separated in the x direction by two grids 704 (2dx). Accordingly, the nozzle interval in the y direction is 8dx (=2dx/tan θ).

Because the orifice pitch in the orifice-line direction 302 is set to 75 orifices/inch as described above, the resolution interval dx is 41 μm, so the resolutions of the printed image 114 in the x and y directions are both 619 dpi (1/dx and 1/dy, respectively).

Although the adjacent orifices 201 are separated by 2dx in the x direction, because ink droplets 501 ejected from a single orifice 201 hit on four different x-scanning lines 701, a dot on every grid corners is formed by two ink droplets 501 ejected from two orifices 201.

FIGS. 8(*a*) to 8(*c*) show relationships between the charging electric field E1, the ejection data 112, and the impact positions 703. In FIG. 8(*a*), a sheet-feed time t0, t1, t2, . . . is a time duration required to move the recording sheet 502 by a single grid in the y direction (1dy), which is referred to as "dot frequency". The sheet-feed time is further divided into n dot-forming time segments t00, t01, t02, t03, t10, t11, t12, t13, t20, . . . , which is referred to as "deflected-dot frequency". In each dot-forming time segment, a single dot is formed by a single nozzle 107*a*. Because the deflection number n is 4 in this example, the dot-forming time segment is ¼ of the sheet-feed time.

As shown in FIGS. 8(*a*) and 8(*c*), the ejection data 112 is output for a dot (x3, y0) at the dot-forming time t00. As a result, as shown in FIG. 8(*d*), an ink droplet 501 ejected from the orifice 201 is deflected rightward perpendicular to the orifice-line direction 302, and impacts on a y-scanning line x3 on the recording sheet 502. At this time, the impact position 703 is on the grid corner (x3, y0).

At the subsequent dot-forming time t01, the magnitude of the charging electric field E1 has been changed as shown in FIG. 8(*b*), and the ejection data 112 for (x2, y0) is output. Accordingly, the ejected ink droplet 501 is deflected rightward and impacts on the y-scanning line x2 as shown in FIG. 8(*e*). Because the recording sheet 502 has been transported by a distance of 1dy/4 by this moment, the impact position 703 is on the grid corner (x2, y0). Then, at the dot-forming time of t02, the magnitude of the charging electric field E1 has been changed as shown in FIG. 8(*b*), and the recording sheet 502 has been moved by a distance of another 1dy/4. The ejection data 112 for (x1, y0) is output, and as shown in FIG. 8(*f*), the ejected ink droplet 501 is deflected leftward perpendicular to the orifice-line direction 302 and impacts on the grid corner (x1, y0) on the y-scanning line x1. At the dot-forming time t03, the magnitude of the charging electric field E1 has been changed as shown in FIG. 8(*b*), and the ejection data 112 for (x2, y0) is output. Accordingly, as shown in FIG. 8(*g*), the ejected ink droplet 501 is deflected leftward and impacts on the y-scanning line x0.

During the sheet-moving time t1 and on, the same processes are performed, so dots are formed on every grid corner.

It should be noted that because the flying time T is constant regardless of the deflection amount C as described above, it is unnecessary to take the flying time T (sheet transporting speed) into consideration when determining the ink ejection timing. In actual printing, the recording sheet 502 is moved by a predetermined distance in the y direction while the flying time T. Therefore, it would be only necessary to be aware that all the actual impact positions 703 would shift by a predetermined distance in the y direction. Also, the timing of changing the magnitude of the charging electric field E1 is set to the exact time of when the ink droplet 501 is generated, that is, when the ink droplet 501 is separated from remaining ink in the nozzle 107*a*. This can be achieved by setting the actual timing to a time a predetermined time duration after the ejection data 112 is output, that is, after the piezoelectric element is driven. This timing can be obtained through experiments.

Figure 9:
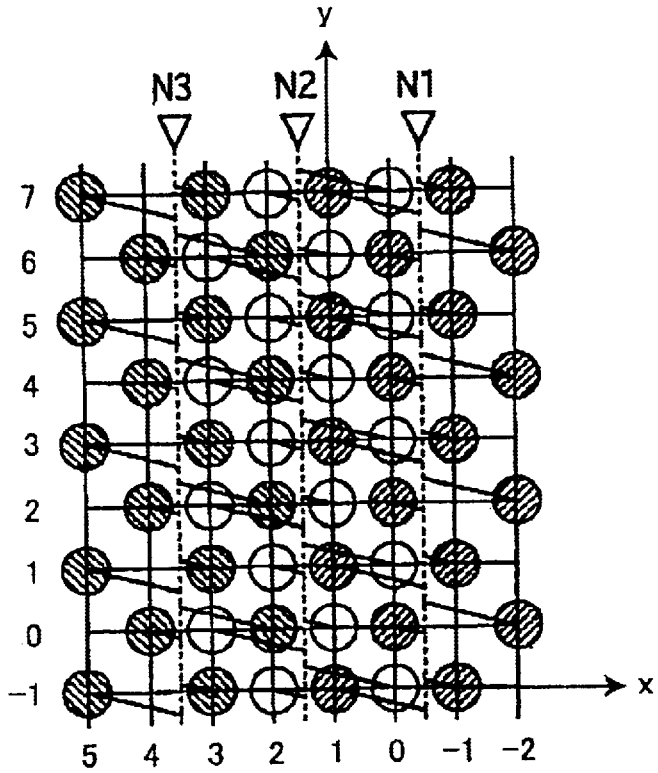
FIG. 9 is an explanatory view showing an example of ink ejection and deflection.

Next, an example of ejection-deflection operation will be described while referring to FIG. 9.

When printing is performed using all the nozzles 201, two ink droplets 501 from different nozzles 201 forms one dot on respective grid corners 704*a*. Accordingly, it is possible to select which one of two nozzles 201 to use for forming a dot on a corresponding grid corner 704*a*. In an example of FIG. 9, a dot (x0,y0) is formed by a nozzle N1. A dot (x0, y1) is formed by a nozzle N2. A dot (x0, y2) is formed by the nozzle N1, and a dot (x0, y3) is formed by the nozzle N2. By forming dots on a single y scanning line 702 by using two nozzles 201 in alternation in this manner, it is possible to prevent uneven color density appearing on an image in a form of banner extending in the y direction, which is due to uneven nozzle characteristics.

Figure 10:
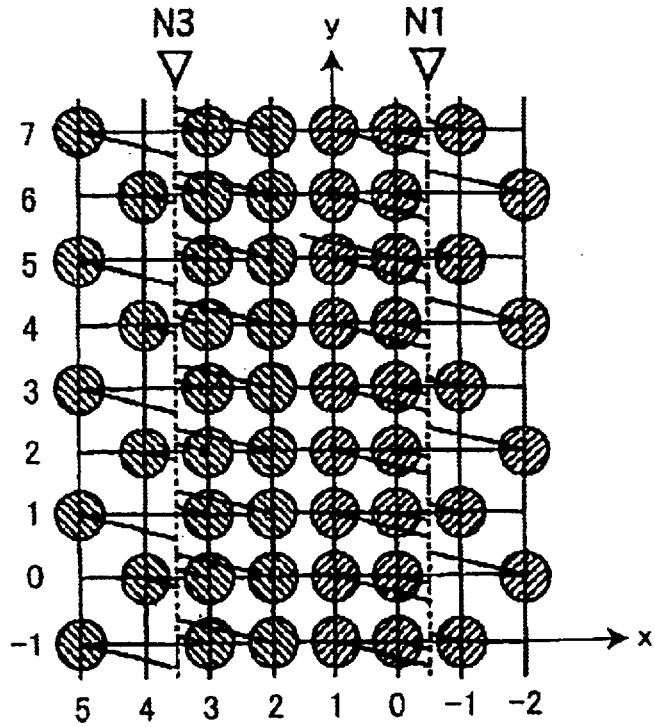
FIG. 10 is an explanatory view of adjusted ink ejection and deflection for when a nozzle N2 becomes defective.

Next, a restored printing for when a nozzle 201 becomes defective will be described while referring to FIG. 10. In this example, it is assumed that the nozzle N2 becomes defective. When the nozzle N2 becomes defective, dots (x1, y0), (x0, y1), (x1, y2), (x0, y3), (x1, y4), and on, which are originally allocated to the nozzle N2, are formed by the nozzle N1, and dots (x3, y0), (x2, y1), (x3, y2), (x2, y3), (x3, y4) and on, which are also originally allocated to the nozzle N2, are formed by the nozzle N3.

In this restored printing, dots can be formed on all grid corners 704*a* without using the defective nozzle N2. Although this operation is not useful for when two adjacent nozzles become defective, there is only a slight possibility that any one nozzle 201 becomes defective during printing, there is hardly a possibility that two adjacent nozzles 201 become defective, so that there is no need to take that possibility into consideration. Therefore, it can say that the above operation enables forming of dots on all grid corners 704*a*without using any defective nozzles 201. In this case, the ejection data 112 is generated by the signal processing portion 101 in accordance with the current restored printing.

Next, an explanation will be provided for the switching of the printing while referring to FIGS. 1, 11, and 12 and also a table shown later. The ejection-deflection operations are when at least one nozzle is detected defective in a detection operation.

The detection unit 110 shown in FIG. 1 detects whether the printing is normal or defective, and outputs a detection signal to the detection-restoring unit 111. Specifically, the detection unit 110 detects whether all the nozzles having performed ejection are normal or at least one of the nozzles having performed ejection is defective. If all the nozzles are normal, a detection signal of 1 is output. On the other hand, if at least one of the nozzles is defective, then a detection signal of 0 is output.

Upon reception of the detection signal of 0, the detection-restoring unit 111 outputs a restore signal to the signal processing portion 101, commanding to restore the printing. The signal processing portion 101 changes a generation method of the ejection data 112 so as to generate the ejection data 112 that is adjusted for a restoring printing. It should be noted that the actual detection-restoring unit 111 is realized as one of the processes of the signal processing portion 101. However, in the present example, the detection-restoring unit 111 is described as a component separated from the signal processing portion 101 so as to facilitate the explanation.

Next, the detection unit 110 is described. The detection unit 110 detects change in electric current conducted through a power source that generates the deflecting voltage Vdef of the charging voltage Vchg. As described above, a charged ink droplet from a normal nozzle 201 reaches the recording sheet without impacting on the electrode 401 nor 402. Therefore, no electric current is conducted through the electrodes 401, 402. However, an ink droplet ejected at an angle or a splashed minute ink droplet from a defective nozzle 201 impacts on the electrode 401 or 402. Because these ink droplets are charged, electric current is conducted through the electrode 401, 402. The detection unit 110 outputs the detection signal of 1 when detecting no current and the detection signal of 0 when detecting the current.

It should be noted that this detection method cannot detect ejection failure although it can detect angled ejection and splash. Usually, ejection failure is detected by a laser beam light or CCD sensor after test printing. However, the angled ejection or splash usually occurs before the nozzles become completely clogged. That is, the detection method of the present invention can detect presence of defective nozzles before these nozzles become incapable of ink ejection.

In the present detection, a condition register S is used. The register S is a memory region with a specific function secured within the signal processing portion 101. The condition register S includes a plurality of elements for respective nozzles 201. In this example, it is assumed that n nozzles 201 and accordingly n elements are provided. Each of the n elements takes three condition values 0, 1, 2, wherein the condition value of 0 represents that a corresponding nozzle is defective, the condition value of 2 represents that a corresponding nozzle is normal, and the condition value of 1 represents that a condition of a corresponding nozzle is unknown. Usually, all the elements of the register S initially take the condition value of 1, indicating unknown. Needless to say, if there is any nozzle whose condition is known, the corresponding value takes either 0 or 2, instead.

Ejection data D is detected by the detection-restoring unit 111 before ejection. The ejection data D includes n bits for the respective n nozzles. Each bit takes an ejection value of 1 for ejection or a non-ejection value of 0 for non-ejection. When the signal processing portion 101 generates one-page-worth of the ejection data 112, the one-page worth of or a portion of the one-page-worth of the ejection data D is stored in the detection-restoring unit 111, and the detection-restoring unit 111 refers to thus stored ejection data D at the time of detection.

The detection-restoring unit 111 does not perform the detection of the ejection data D every time when the ejection is performed because it is time consuming. In the present embodiment, the detection is performed every time the ejection is performed 1,024 times, or about 5 Hz. That is, the detection-restoring unit 111 stores the ejection data D once every 1,024 times the signal processing portion 101 generates the ejection data 112.

At the time of the selective ink ejection, when the detection unit 110 outputs the detection signal of 1 indicating normal ejection, this means that all the nozzles having performed the ink ejection, that is, the nozzles corresponding to the ejection value of 1, are normal. On the other hand, when the detection unit 110 outputs the detection signal of 0 indicating defective ejection, this means that at least one of the nozzles having performed the ejection is defective. However, as described above, a defective nozzle cannot be identified by simply detecting the conducted electric current.

Figure 11:
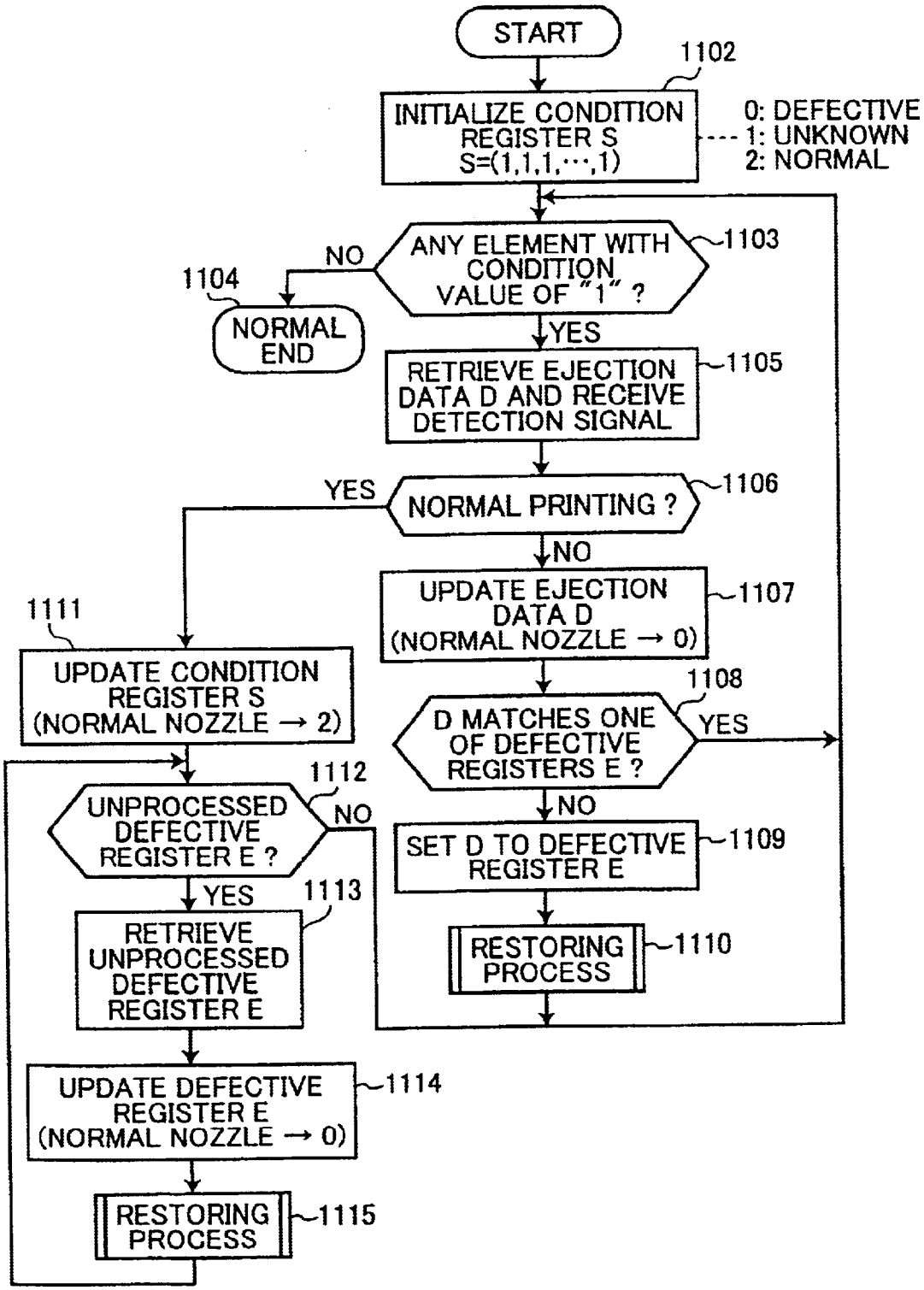
FIG. 11 is a flowchart representing a detecting process according to a first embodiment of the present invention.
Figure 12:
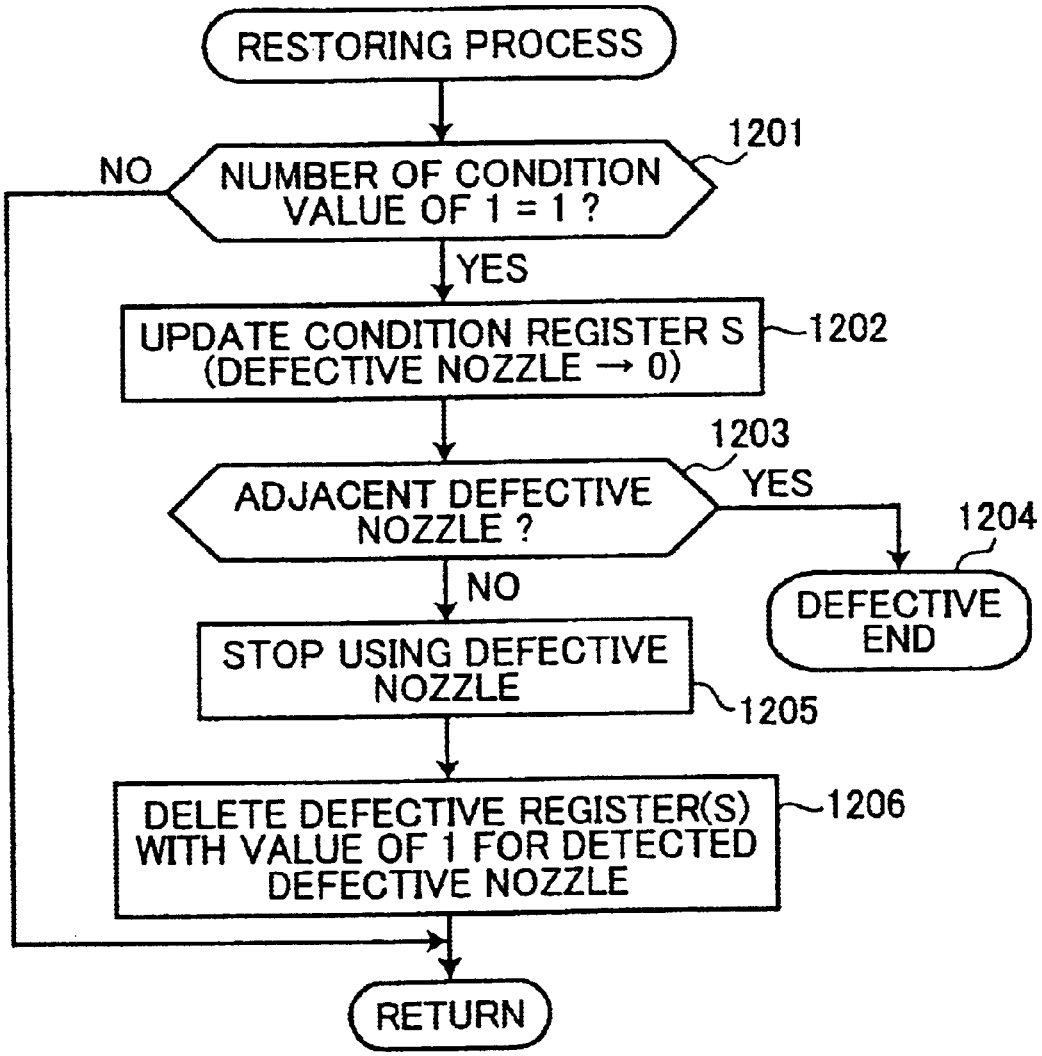
FIG. 12 is a flowchart representing a restoring process executed in S1110 and S1115 of FIG. 11.

In the present embodiment, the defective nozzle is identified in a detection process represented by a flowchart of FIG. 11. Details will be described next.

It should be noted that in the present example it is assumed that the condition of all the n nozzles are unknown, and also that there is no defect register E (Hereinafter referred to as 'defective register') at the beginning.

When the routine is started in S1101, first in S1102 all the condition values of the condition register S are initialized to 1 that represents the unknown condition.

Next, in S1103, it is determined whether or not there is no nozzle with unknown condition, i.e., whether or not the condition register S has any element with the condition value of 1. If not (S1103:NO), the present process is brought to a normal end in S1104.

On the other hand, if so (S1103:YES), then the process proceeds to S1105. In S1105, detection restoring unit 111 gets the ejection data D from the signal processing portion 101, and gets the detection signal from detection unit 110. Then, in S1106, it is judged whether or not the printing is normal based on the signal from the detection unit 110.

If the printing is defective (S1106:NO), this means that there is at least one defective nozzle among the nozzles with the ejection value of 1, then the process proceeds to S1107. In S1107, the ejection data D is updated based on the condition register S, where the values in the ejection data D are set to 0 for the normal nozzles, that is the nozzles with the condition value of 2, and the values for the others are maintained the same. Next in S1108, the updated ejection data D is compared with a set of defective registers E to judge whether or not there is any defective register E that matches the updated ejection data D. If so (S1108:YES), the process returns to S1103. On the other hand, if S1108 results in a negative determination (S1108:NO), and then in S1109 the updated ejection data D is set to a defective register E and added to the set of the defective registers E. The defective register E is generated in this manner and increases its number.

Next, in S1110, the newly added defective register E is set as an argument, and a restoring process is executed for the defective register E. FIG. 12 shows a flowchart representing the restoring process.

When the restore process is started, first in S1201 it is detected whether or not the number of the element in the defective register E that has the value of 1 is only one. If not (S1201:NO), the present routine is ended. On the other hand, if so (S1201:YES), this means that the nozzle that corresponds to the element with the value of 1 is the one that is defective. Then in S1202, the condition register S is updated such that the condition value for the defective nozzle is set to 0 indicating the defective condition.

Next in S1203, it is determined whether or not the detected defective nozzle is adjacent to an existent defective nozzle which has been detected earlier. If so (S1203: YES), then in S1204 the present routine is brought to an end. That is, because the above-described restored printing is not useful in this case as described above, the printing is stopped, and then any restoring operation, such as cleaning operation, is performed.

As described above, there is hardly a possibility that two adjacent nozzles become defective during the printing. Also, even if a plurality of nozzles becomes defective, printing can be properly performed as long as the plurality nozzles are not adjacent to one another.

If S1203 results in a negative determination (S1203:NO), then in S1205, restored printing is performed without using the defective nozzle. In S1206, all the defective registers E so that the condition value for the detected defective nozzle is 1 is deleted from the set of the defective registers E. Then, the process returns.

On the other hand, if S1106 results in a positive determination (S1106:YES), this means that all the nozzles with the ejection value of 1 are normal. Then, in S1111, the condition register S is updated so that the condition values for these normal nozzles are set to 2. Next, in S1112, it is determined whether or not any unprocessed defective register E exists in the set of the defective registers E. If not (S1112:NO), the process returns to S1103. If so (S1112:YES), then in S1113 one unprocessed defective register E is retrieved, and in S1114 the defective register E I updated so that the value for the normal nozzle is set to 0. Then, in S1115, the adjustment process shown in FIG. 12 is executed, and the process returns to S1112. The same process is repeated for any unprocessed defective register E.

A specific example of the above-described detecting process will be described while referring to a following table T. Explanation will be provided while referring to line numbers (No.) in the left most column of the table 1. In the present example, it is assumed that the ink jet recording device is formed with eight nozzles in order to simplify the explanation. Also, it is assumed that second and seventh nozzles among the eight nozzles are defective as indicated at No. 1 of the table 1. Needless to say, the defectiveness of the second and seventh nozzles is unknown before the detecting process.

TABLE T

| No | STEP | ITEM | REGISTER | VALUES 12345678 | NUMBER OF 1 | DETECTION RESULT | DESCRIPTION |
|---|---|---|---|---|---|---|---|
| 1 | | nozzle conditions (initially unknown) | | 20222202 | 8 | | 0: Defective 2: Normal 2: Normal 1: Unknown 0: Defective |
| 2 | 1102 | condition register S (initial value) | S | 11111111 | | | |
| 3 | 1105 | ejection data D | D | 01110001 | | | 0: Nonejection 1: Ejection |
| | | detection result | | | | 1 | sensor result (1: Defective 0: Normal) |
| 4 | 1106 | defective | | | | | |
| 5 | 1107 | update ejection data D | D | 01110001 | | | normal nozzle (Sn = 2) → 0 |
| 6 | 1109 | defective register E1/number of 1 | E1 | 01110001 | 4 | | number is not 1 → skip |
| 7 | 1105 | ejection data D | D | 01011101 | | | 0: Nonejection 1: Ejection |
| | | detection result | | | | 1 | sensor result (1: Defective 0: Normal) |
| 8 | 1106 | defective | | | | | |
| 9 | 1107 | update ejection data D | D | 01011101 | | | normal nozzle (Sn = 2) → 0 |
| 10 | 1108 | no D in defective registers | | | | | |
| 11 | 1109 | defective register E2/number of 1 | E2 | 01011101 | 5 | | not 1 → skip |
| 12 | 1105 | ejection data D | D | 00010101 | | | 0: Nonejection 1: Ejection |
| | | detection result | | | | 0 | sensor result (1: Defective 0: Normal) |
| 13 | 1106 | normal | | | | | |
| 14 | 1111 | update condition register S | S | 11121212 | | | normal nozzle → 2 |
| 15 | 1114 | defective register E1/number of 1 | E1 | 01100000 | 2 | | normal nozzle → 0, not 1 → skip |
| 16 | 1114 | defective register E2/number of 1 | E2 | 01001000 | 2 | | normal nozzle → 0, not 1 → skip |
| 17 | 1105 | ejection data D | D | 01010101 | | | 0: Nonejection 1: Ejection |
| | | detection result | | | | 1 | sensor result (1: Defective 0: Normal) |
| 18 | 1106 | defective | | | | | |
| 19 | 1107 | update ejection data D | D | 01000000 | | | normal nozzle (Sn = 2) → 0 |
| 20 | 1108 | no D in defective registers | | | | | |
| 21 | 1109 | defective register E3/number of 1 | E3 | 01000000 | | | is 1 → restore |
| 22 | 1201 | E3/number = 1 → restore | | | 1 | | |
| 23 | 1202 | update condition register S | S | 10121212 | | | defective nozzle → 0, restore |
| 24 | 1206 | delete defective register E | | | | | delete E including defective nozzle |
| 25 | 1105 | ejection data D | D | 00001110 | | | 0: Nonejection 1: Ejection |
| | | detection result | | | | 1 | sensor result (1: Defective 0: Normal) |
| 26 | 1106 | defective | | | | | |
| 27 | 1107 | update ejection data D | D | 00001010 | | | normal nozzle (Sn = 2) → 0 |
| 28 | 1108 | no D in defective registers | | | | | |
| 29 | 1109 | defective register E1/number of 1 | E1 | 00001010 | 2 | | normal nozzle → 0, not 1 → skip |
| 30 | 1105 | ejection data D | D | 00101100 | | | 0: Nonejection 1: Ejection |
| | | detection result | | | | 0 | sensor result (1: Defective 0: Normal) |
| 31 | 1106 | normal | | | | | |
| 32 | 1111 | condition register S | S | 10222212 | | | normal nozzle → 2 |
| 33 | 1114 | defective register E1/number of 1 | E1 | 00000010 | 1 | | normal nozzle → 0, is 1 → restore |
| 34 | 1201 | E1/number = 1 → restore | | | | | |
| 35 | 1202 | condition register S | S | 10222202 | | | defective nozzle → 0, restore |
| 36 | 1206 | delete defective register E | | | | | delete E including defective nozzle |
| 37 | 1105 | ejection data D | D | 10010000 | | | 0: Nonejection 1: Ejection |
| | | detection result | | | | 0 | sensor result (1: Defective 0: Normal) |
| 38 | 1106 | normal | | | | | |
| 39 | 1111 | update condition register S | S | 20222202 | | | normal nozzle → 2 |
| 40 | 1112 | | | | | | no set of defective registers E |
| 41 | 1103 | number of 1 within condition register S | S | 20222202 | 0 | | |
| 42 | 1104 | | | | | | normal end |

First, at No. 2, the process of S1102 in FIG. 11 is executed, and all the elements of the condition register S are initialized to the condition value of 1, the condition value of 1 indicating unknown condition. Accordingly, S1103 results in a negative determination (S1103:NO). Next, at No. 3, the process of S1105 is executed to perform selective ejection. The ejection data D at this time is "01110001", for example. Also in S1105, detection signal is received from the detection unit 110. In this example, the detection signal of 1 is received, and so S1106 results in a negative determination (S1106:NO), i.e., defective, at No. 4. At No. 5, the ejection data D is updated based on the condition register S in S1107. In this example, the ejection data D is unchanged at this time.

Because there is no defective register E identical to the updated ejection data D (S1108:NO), the updated ejection data D is set as a defective register E1 and added to a set of defective registers E (S1109) at No. 6. Because the defective register E1 includes four values of 1 at this time, S1201 results in a negative determination (S1201:NO), and the process returns to S1103. The same processes are repeated at No. 7 through No. 11.

At No. 12 in S1105, the detection signal of 0 is received, so it is judged the normal ejection in S1106 at No. 13 (S1106:YES). Because the ejection data D at No. 12 has the ejection value of 1 for the fourth, sixth, and eighth nozzles, these nozzles are determined to be normal, and the condition values of the condition register S for these normal nozzles are set to 2 in S1111 at No. 14. In S1114 at No. 15, the defective register E1 shown at No. 6 is updated as shown at No. 15, where the condition values for the normal nozzles are changed from 1 to 0. The resultant values are "01100000" as shown at No. 15. Because there are two condition values of 1, S1201 results in a negative determination (S1201:NO), and so the process returns to S1112. Then, the same process is executed to the subsequent defective register E2 in S1113 and S1114. No. 16 shows the defective register E2 updated from the defective register E2 of No. 11 by replacing the value of 1 to 0 for the normal nozzles. In this case also, the number of the condition values of 1 is not one, but two, so S1201 results in a negative determination, and the process returns to S1112. Because there is no more unprocessed defective register E (S1112:NO), the process returns to S1103.

At No. 17 through No. 21, the processes of S1105 through S1109 are performed in the same manner. At No. 22, because the defective register E3 has only one value of 1, it is determined that the second nozzle, in this example, is defective. S1201 results in an affirmative determination at No. 22 (S1201:YES), and then in S1202, the condition register S is updated so that the condition value for the defective nozzle (second nozzle) is changed to 0. In this case, the updated register S has the values of "10121212" as shown at No. 23. Because there is no adjacent defective nozzle in this example (S1203:NO), it is stopped using the defective nozzle, and normal nozzles next to the defective nozzle cover up the defective nozzle and form dots, which are originally allocated to the defective nozzle, instead of the defective nozzle. Then, all the defective registers E having the condition value of 1 for the defective nozzle (second nozzle) are deleted in S1206 at No. 24. In this example, the defective registers E1, E2, and E3 are all deleted.

When the same process is repeatedly executed, the remaining seventh nozzle is detected to be defective in S1114 at No. 15, and eventually at No. 41 it is determined in S1103 that the condition register S includes no condition value of 1. Then, the process is brought to the normal end in S1104.

Although not described in the above example, it may be determined in S1203 that the defective nozzle is in adjacent to another defective nozzle, and then the defective end may result. In this case, the printing is stopped, and the restoring process is executed as described above.

According to the present embodiment, when a nozzle becomes defective during the printing, the defective nozzle is automatically detected and proper printing can be restored without a need to stop the printing.

Next, a detecting process according to a second embodiment of the present invention will be described while referring to a flowchart shown in FIG. 13. In the above-described first embodiment, the restoring operation is performed only after the number of condition values of 1 within the defective register E becomes one. However, when two or more nozzles become defective and when these defective nozzles are those that highly likely perform ink ejection at the same time, the number of condition values of 1 will not easily reach one. In this case, it takes relatively a long period of time before the restoring operation starts. Moreover, the accumulated number of the defective registers E becomes so large that the data value may exceed the capacity of the memory, resulting in memory overflow.

The restoring process of the second embodiment overcomes such a problem. Specifically, when the number of the defective registers E reaches a predetermined number, the following process is executed. Also, there is provided a defective additional memory ES including a plurality of elements for the respective nozzles. Each of the elements includes a plurality of bits, and functions as a memory for storing an element value. Details will be described below.

Figure 13:
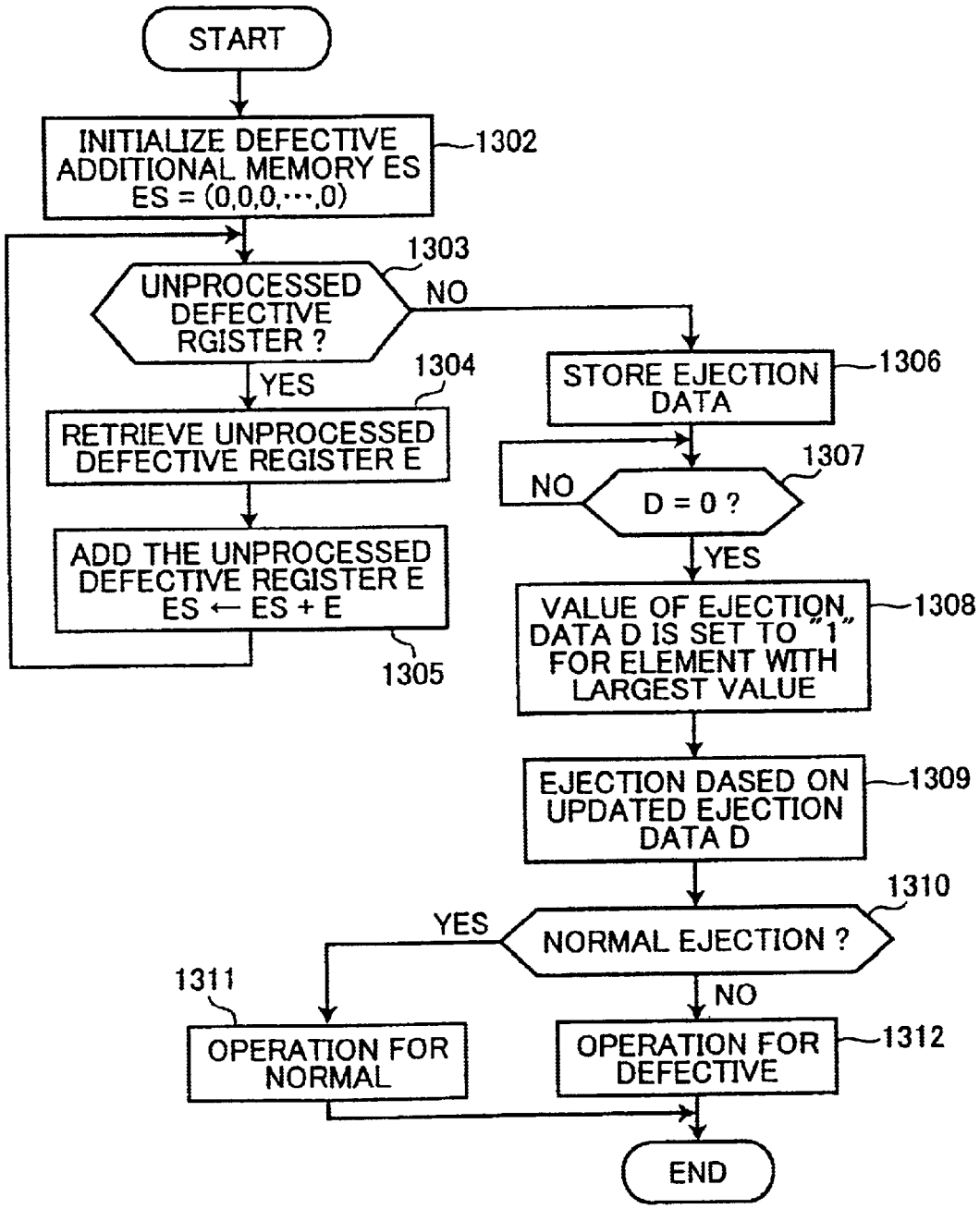
FIG. 13 is a flowchart representing a detecting process according to a second embodiment of the present invention.

In the flowchart of FIG. 13, when the process starts in S1301, all element values of the defective additional memory ES are initialized to 0 in S1302. Next in S1303, it is detected whether or not there is any unprocessed defective register E. If so (S1303:YES), then in S1304, one unprocessed defective register E is retrieved. Then, in S1305, the condition values of the retrieved defective register E are added to the corresponding elements of the defective additional memory ES, and the process returns to S1303. The same processes of S1304 and S1305 are executed to all unprocessed defective registers E. When S1303 results in a negative determination (S1303:NO), then in S1306, the ejection data D is received. When the received ejection data D have only the values of 0, indicating no ejection, (S1307:YES), then the process proceeds to S1308. In S1308, a nozzle corresponding to an element of the defective additional memory ES with the largest value is identified, and the value of the ejection data D for the detected nozzle is changed from 0 to 1 so that only the detected nozzle performs the ejection. In this way, the ejection data D is updated. Next, in S1309 the ejection is performed based on the updated ejection data D, and the detection signal is received from the detection unit 110. At this time, one dot is formed (test printed) on a recording sheet although no dot is supposed to be formed. However, degradation in the printed result due to the one unnecessary dot is far less than that caused by defective ink ejection from a defective nozzle, and such degradation is small enough to ignore. Then, in S1310, it is determined whether or not the ejection is normal. If defective (S1310:NO), the same operations as that of S1107 through S1110 in FIG. 11 are executed in S1312, and the process is ended in S1313. On the other hand, if normal (S1310:YES), the same processes of S1111 through S1115 in FIG. 11 are executed in S1311, and the process is ended in S1313.

As described above, according to the second embodiment, the test printing is performed where a single dot is formed by a single nozzle. Because the single nozzle is highly likely the defective nozzle, the defective nozzle can be promptly detected in an effective manner. Accordingly, the defective nozzle is stopped from being used at an earlier stage, so that degradation of an image quality can be reduced. Further, the number of the defective registers E is greatly reduced regardless of whether the tested nozzle is normal or defective, so that the memory overflow can be prevented.

Next, a third embodiment of the present invention will be described while referring to FIG. 14. In this embodiment, the electric-current detection is performed by using a laser beam.

Figure 14:
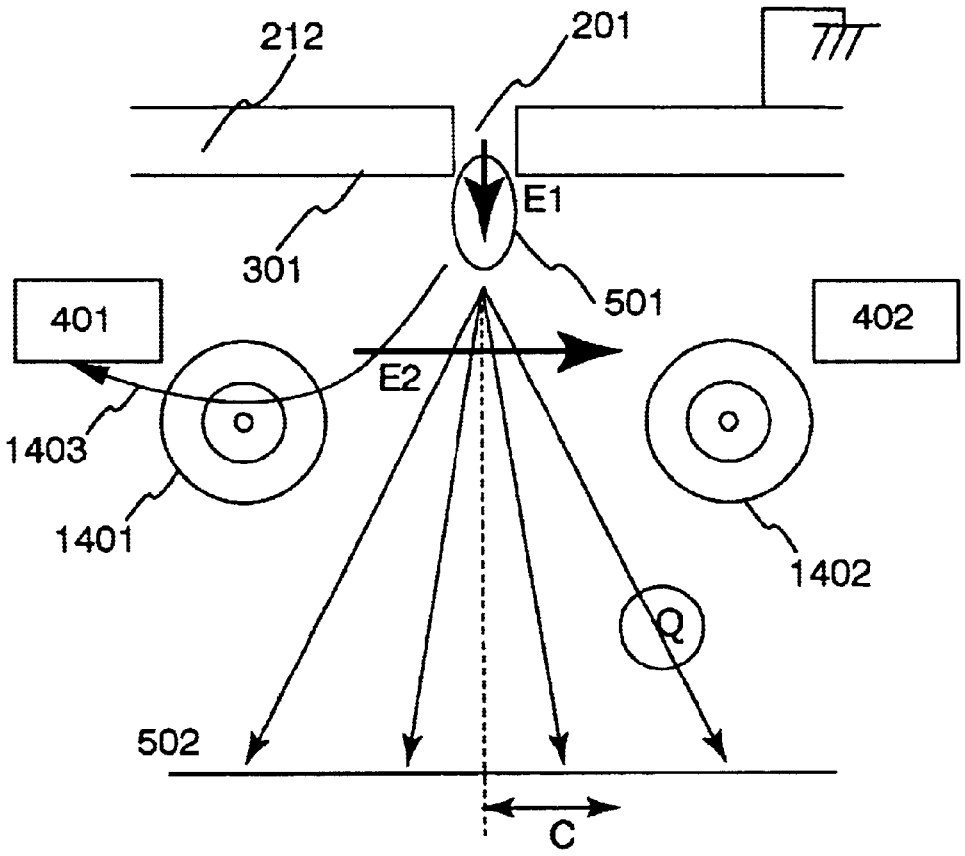
FIG. 14 is a cross-sectional view showing a configuration of an ink jet head according to a third embodiment of the present invention.
Figure 15:
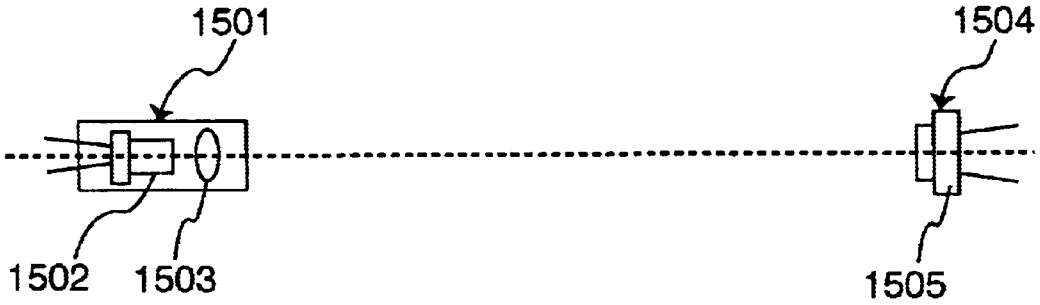
FIG. 15 is a plan view sowing a laser beam generator and a laser beam receptor according to the third embodiment of the present invention.

The ink jet head 107 of the third embodiment includes a laser-beam generator 1501 and a laser-beam receptor 1504 shown in FIG. 15 at the ends of corresponding nozzle line for generating a laser beam 1401 or 1402 shown in FIG. 14 between the laser-beam generator 1501 and the laser-beam receptor 1504. The laser-beam generator 1501 includes a well-known semiconductor laser 1502 and a collimate lens 1503. The laser-beam receptor 1504 includes a well-known photodiode 1504 and a signal detection circuit (not shown). The axis of the laser beam 1401, 1402, is parallel to the nozzle line direction 302. A plurality of concentric circles of the laser beam 1401, 1402 indicates its strength distribution. A charged splash from a nozzle 201 flies to the electrode 401 as indicated by an arrow 1403 and impacts thereon. Because the laser beam 1401 intersects the path 1403, the splash flying along the path 1403 blocks the laser beam 1401, so that the amount of the laser beam 1401 received be the laser-beam receptor 1504 reduces. Accordingly, the occurrence of splash can be detected by detecting change in the amount of the laser beam 1401, 1402 reaching the laser-beam receptor 1504. Because the splash flies to the electrode 402 in the same manner, only one of the laser beams 1401 and 1402 is necessary for the detection.

In this method also, a defective nozzle cannot be identified by merely detecting the change in the laser beam amount, although the occurrence of defective ejection can be detected. However, the same process as that of the first or second embodiment can be executed in the third embodiment also in order to identify the defective nozzle.

According to the third embodiment, ink droplets ejected at angle and splashed minute droplets can be detected even when these do not reach and impact on the electrodes 401, 402, so a nozzle, which is not completely defective but incapable of proper ejection, can also be detected. Accordingly, the above restoring operation can be performed at an earlier stage, and so the degradation of the image quality can be minimized.

As described above, according to the present invention, the electrodes for generating a charging electric field and deflector electric field can be provided common to a plurality of nozzles. This provides a highly reliable multi-nozzle head. Also, because ink droplet ejections are performed at constant intervals, a maximum ejection rate available for the nozzles can be used. Further, it is possible to perform a multiple ejection, where a single dot is formed by a plurality of ink droplets from different nozzles, and so the reliability can be increased as needed. Moreover, the ink droplet ejection in a non-rectangular coordinate system with honeycomb shape is also possible. In this case, the amount of overlapping regions among adjacent dots can be minimized, so the ink consumption can be reduced.

While some exemplary embodiments of this invention have been described in detail, those skilled in the art will recognize that there are many possible modifications and variations which may be made in these exemplary embodiments while yet retaining many of the novel features and advantages of the invention.

Although in the above-described embodiment, the orifices 201 are aligned in the pitch of 75 orifices/inch, the nozzles 107*a* can be aligned in the pitch of 150 orifices/inch. In this case, a resolution will be twice the above-described resolution. Also, the number of nozzles 107*a* (orifices 201) is not limited to 128.

Also, the present invention can be also applied to an ink jet recording device where printing is performed while a recording head is moved and a recording sheet stays still rather than where the printing is performed while the recording sheet is moved and the recording sheet stays still.

Further, the present invention can also be applied to bubble jet recording device where an air bubble is generated by applying head, and ejecting ink by utilizing the pressure of the generated air bubble.

What is claimed is:

1. An ink jet recording device comprising:

a head formed with a plurality of nozzles through which ink droplets are selectively ejected based on ejection data during actual printing;

electrodes that generate a charging electric field for charging the ink droplets ejected from the head and a deflector electric field for deflecting the ink droplets charged by the charging electric field, the electrodes being provided common to the plurality of nozzles;

first detecting means for detecting whether all of selected nozzles through which ink droplets are ejected based on the ejection data are normal or at least one of the selected nozzles is defective;

identifying means for automatically identifying, without performing test-pattern printing while the actual printing is not being performed, a defective nozzle while the head is continuously performing the actual printing based on the ejection data when the first detecting means detects that the ejection is performed defectively.

2. The ink jet recording device according to claim 1, further comprising restoring means for automatically restoring proper printing of the head when the identifying means identifies the defective nozzle.

3. The ink jet recording device according to claim 2, further comprising a memory storing a defect register including a plurality of elements each taking one of a first value indicating a defectiveness of a corresponding nozzle and a second value indicating normalness of a corresponding nozzle, wherein the identifying means updates the defect register based on the ejection data, and the restoring means restores the proper printing of the head when only one of the elements in the defect register takes the first value.

4. The ink jet recording device according to claim 3, wherein the memory further stores a condition register including a plurality of elements for respective nozzles, each of the elements takes one of a normal-condition value indicating normal condition of the corresponding nozzle, a defective-condition value indicating defective condition of the corresponding nozzle, and an unknown-condition value indicating unknown condition of the corresponding nozzle.

5. The ink jet recording device according to claim 4, wherein the identifying means updates the condition register based on the ejection data when the first detecting means detects that the ejection is performed normally.

6. The ink jet recording device according to claim 4, wherein the identifying means updates the condition register based on the ejection data when the ejection is detected as normal.

7. The ink jet recording device according to claim 4 wherein the restoring means rearranges the dot allocation to not use the defective nozzle identified by the identifying means.

8. The ink jet recording device according to claim 3, in the head selectively ejects ink droplets through the nozzles to form dots on a recording medium, the dots being allocated to corresponding nozzles, and the restoring means restores the proper printing of the head by rearranging the dot allocation to the plurality of nozzles.

9. The ink jet recording device according to claim 1, wherein the identifying means includes searching means for searching a nozzle from the plurality of nozzles that is most likely the defective nozzle and second detecting means for detecting ejection data based on which the plurality of nozzles of the head eject no ink droplet, and the restoring means controls the head to eject an ink droplet only from the nozzle searched by the searching means when the second detection means detects the ejection data.

10. The ink jet recording device according to claim 9, further comprising a memory that stores and additional memory that has values for respective nozzles, wherein the identifying means accumulates values of the ejection data to the corresponding values of the additional memory, and the searching means searches the nozzle that is most likely the defective nozzle based on the values of the additional memory.

11. The ink jet recording device according to claim 1, wherein the first detecting means detects whether the ejection is performed normally or defectively by detecting an amount of an electric current conducted through the electrodes.

12. The ink jet recording device according to claim 1, further comprising a laser beam generator that generates a laser beam and a laser beam receptor that receives the laser beam, wherein the first detecting means detects the amount of the laser beam received by the laser beam receptor.

13. The ink jet recording device according to claim 12, wherein the first detecting means detects that the ejection is performed defectively when the amount of the laser beam received by the laser beam receptor is decreased.

14. The ink jet recording device according to claim 13, wherein the plurality of nozzles are aligned in a line in a line direction, and the laser beam extends parallel to the line direction.

15. A method of detecting a defective nozzle among a plurality of nozzles formed in a head of an ink jet recording device that includes the head and a pair of electrodes for generating a deflection electric field common to the plurality of nozzles, comprising the steps of:

a) detecting whether all of selected nozzles through which ink droplets are ejected based on ejection data during actual printing are normal or at least one of the selected nozzles is defective; and b) identifying, without performing test-pattern printing while the actual printing is not being performed, a defective nozzle among the plurality of nozzles while the head is continuously performing the actual printing based on the ejection data when the ejection is detected as defective in step a).

16. The detecting method according to claim 15, further comprising the steps of:

c) stopping use of the nozzle that is identified defective in step b); and d) reallocating dots, which were originally allocated to the defective nozzle, to a nozzle other than the defective nozzle.

17. The detecting method according to claim 15, wherein the ejection is detected as defective in the step a) when electric current conducted through the electrodes is increased.

18. The detecting method according to claim 15, wherein the ejection is detected as defective in the step a) when an amount of a laser beam received by a laser beam receptor is decreased, the laser beam extending parallel to, and displaced from a direction in which a plurality of nozzles are aligned in a line.

19. The detecting method according to claim 15, wherein the step b) includes the steps of:

e) generating a defect register having elements for respective nozzles based on ejection data;

f) detecting whether the number of elements of the defect register that have a defect-condition value indicating that the corresponding nozzle is defective is zero or at least one; and g) identifying the nozzle that corresponds to the element of the defect register with the defect-condition value when the number is determined one in the step f).

20. The detecting method according to claim 15, wherein the step b) includes the steps of:

h) searching one of the plurality of nozzles that is most likely the defective nozzle;

i) searching ejection data based on which no ejection is performed through any of the plurality of nozzles; and j) updating the ejection data searched in the step 1) such that a non-ejection value of the ejection data corresponding to the nozzle searched in the step h) is changed to an ejection value.

* * * * *